US005342145A

United States Patent [19]

Cohen

[11] Patent Number: 5,342,145

[45] Date of Patent: Aug. 30, 1994

[54] SYSTEM FOR PRODUCING SURFING WAVES FOR TUBE RIDING OR WIND SURFING

[76] Inventor: Albert D. Cohen, 7 Wagstaff Court, Brighton 3186 Melbourne, Australia

[21] Appl. No.: 51,457

[22] Filed: Apr. 21, 1993

[51] Int. Cl.[5] ..... E02B 3/00; E04H 3/18

[52] U.S. Cl. ..... 405/79; 4/491

[58] Field of Search ..... 405/79, 15, 21, 25, 405/80; 4/491

[56] References Cited

U.S. PATENT DOCUMENTS 3,557,559 1/1971 Barr ..... 405/79

4,062,192 12/1977 Biewer ..... 405/79

4,999,860 3/1991 Chutter et al. ..... 405/79 X 5,207,531 5/1993 Ross ..... 405/79

*Primary Examiner*—David H. Corbin

*Attorney, Agent, or Firm*—Arnold, White & Durkee

[57] ABSTRACT

A system for producing plunging waves for surfing in a body of water propagates waves over a reef which forms a wave-breaking surface which has a steepness sufficient to cause the waves to break in a plunging mode as the waves traverse the reef. The waves are artificially generated with a steepness sufficient to break in a plunging mode. Multiple waves are generated in sequence along the offshore side of the reef to produce a wave that peels laterally along the reef to produce a wave suitable for tube riding.

16 Claims, 10 Drawing Sheets

SYSTEM FOR PRODUCING SURFING WAVES FOR TUBE RIDING OR WIND SURFING

FIELD OF THE INVENTION

The present invention relates generally to surfing pools, in which waves suitable for surfing are generated artificially. This invention particularly relates to surfing pools in which the waves that are generated are suitable for "tube riding" by a surfer, and which are also especially useful for windsurfing.

BACKGROUND OF THE INVENTION

Surfing pools containing equipment for generating waves suitable for surfing have been previously proposed and, in some cases, used commercially. Examples of previously proposed surfing pools are described in Australian patent No. 572,116 and U.S. Pat. Nos. 4,062,192; 4,692,949; and 4,812,077.

Previous surfing pools known to the present inventor have not been capable of generating waves suitable for "tube riding," which is riding inside a breaking wave. Tube riding is possible only with waves that break with a space between the breaking lip of the wave and the face of the wave, and that exhibit progressive breaking ("peeling") laterally along the wave front over a long distance. The surfer typically rides the shoulder or base of the wave at the leading edge of the break as it progresses laterally along the wave front, and the surfer can also ride inside the breaking part of the wave or in the tube. Waves of this type are to be contrasted with spilling waves, which break without forming tubes, i.e., there is no space between the breaking part of the wave and the face of the wave.

SUMMARY OF THE INVENTION

It is a primary object of the present invention to provide a surfing pool which produces plunging-type waves that exhibit progressive breaking laterally along the wave front so that the waves can be used for tube riding, and particularly long tube rides.

It is another important object of this invention to provide a surfing pool which produces plunging-type waves that rise steeply so that the waves can be used for windsurfing, and particularly for windsurfing maneuvers in which the windsurfer uses a wave to become airborne.

Another object of this invention is to provide the surfing pool which maintains a substantially constant wave peeling rate along the wave front to facilitate reading of the wave by the surfer.

Other objects and advantages of the invention will become apparent from the following detailed description and the accompanying drawings.

In accordance with the present invention, the foregoing objectives are realized by forming a reef having a wave-breaking surface which inclines upwardly toward the shore at a predetermined angle, and generating waves on the offshore side of the reef and propagating toward the shore, the waves having a steepness sufficient to cause the waves to break in a plunging mode as the waves traverse the wave-breaking surface of the reef. To produce waves that break in a plunging mode, the slope of the inclined wave-breaking surface is preferably in the range of about $\frac{1}{4}$ to 1/25, and is most preferably in the range of about 1/6 to 1/10. When the slope is greater than $\frac{1}{4}$, significant reflection of the incoming wave occurs due to the presence of the reef. When the slope is less than 1/25, the wave breaks without plunging or forming a tube.

To produce a wave that progressively breaks laterally along the wave front, the wave-breaking surface extends laterally at an acute angle from the wave front, and each wave is progressively generated laterally along that surface to produce a wave that peels progressively along the wave-breaking surface, which can be extended over a long distance. Progressive generation of the wave along the wave-breaking surface is accomplished by generating the wave progressively by sequentially producing waves at multiple wave-generating stations distributed along the offshore side of the reef. The sequential generation of these multiple waves is preferably controlled so that the peeling rate of the wave remains essentially constant along the length of the wave-breaking surface, so as to facilitate the reading of the wave by a surfer.

The acute angle between the wave front and the wave-breaking surface is preferably in the range from about 30° to about 70°. At angles greater than 70° the wave tends to peel too fast, making it difficult for the surfer to keep up with the peeling rate and to avoid being overtaken by the lateral breaking. If the angle is less than 30°, excessive energy can be lost on wave breaking, and the wave can become undesirably small before reaching the next input of energy from the adjacent wave-generating machine. By selecting angles within the preferred range, it is possible to achieve different degrees of difficulty of the surfing pool. For a more difficult surfing pool the angle should be closer to the 70° end of the range (to produce quicker peels), and for easier surfing pools the angle should be closer to the 30° end of the range (for slower peels).

DETAILED DESCRIPTION OF THE PREFERRED EMBODIMENTS

Figure 1:
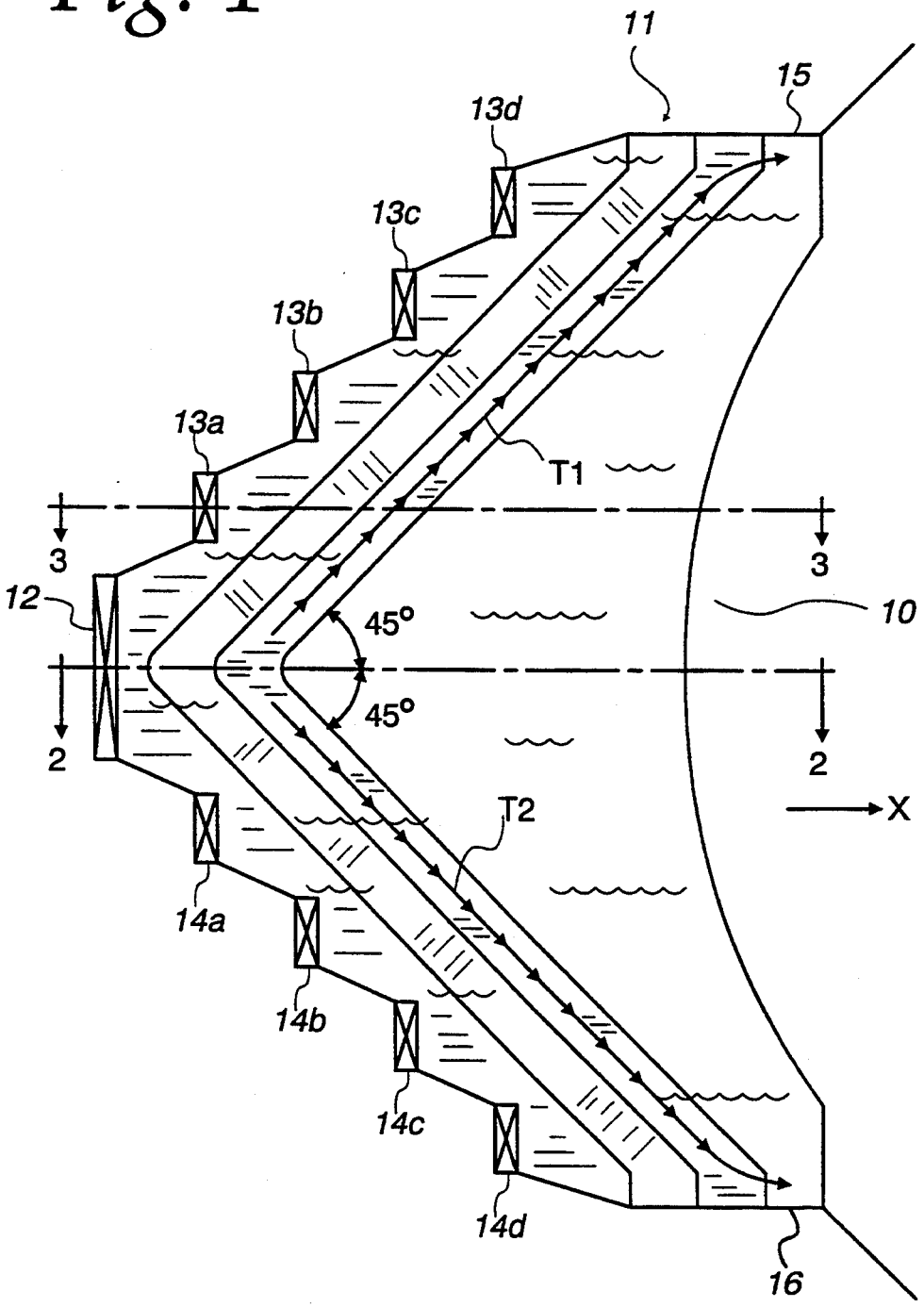
FIG. 1 is top plan view of a surfing pool embodying the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents and alternatives falling within the spirit and scope of the invention as defined by the appended claims.

Turning now to the drawings and referring first to FIG. 1, there is shown a surfing pool for generating waves which break over a reef 11 and then dissipate over a shore 10. The waves are generated by an array of wave-generating machines 12, 13*a*–13*d* and 14*a*–14*d* on the offshore side of the reef 11. Water is contained within the pool by the shore 10, a pair of end walls 15 and 16, and the wave-making machines 12–14 and a series of interconnecting walls between adjacent pairs of the wave machine.

The waves generated by the array of machines 12–14 are propagated toward the shore 10. As the waves pass over the reef 11, the waves break so that they can be ridden by surfers along the lines T1 and T2.

Figure 2:
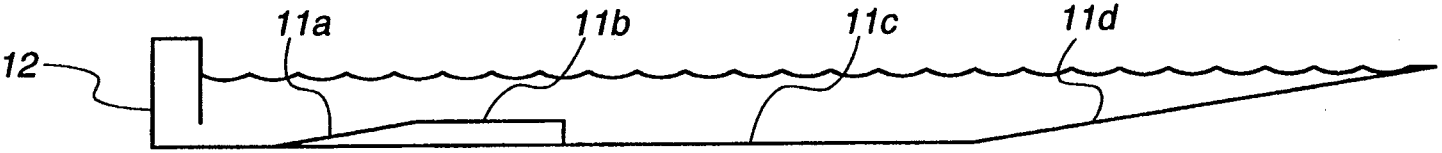
FIG. 2 is an enlarged section taken generally along line 2—2 in FIG. 1.
Figure 3:
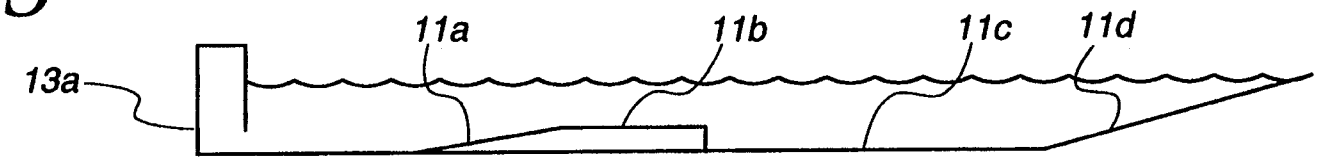
FIG. 3 is an enlarged section taken generally along line 3—3 in FIG. 1.

As can be seen from FIGS. 2 and 3, the offshore side of the reef 11 forms an inclined wave-breaking surface 11*a* which causes the waves to break as they pass over the reef. At the top of the wave-breaking surface 11*a*, the reef flattens out at 11*b*, and then drops vertically to the full depth of the pool at 11*c*. Adjacent the shoreline, the pool bottom slopes upwardly again at 11*d* until it rises above the water level.

For the purposes of the present invention, it is preferred that the waves break in a plunging mode, which normally requires that the slope of the wave-breaking surface 11*a* be in the range of about ¼ to about 1/25, and preferably in the range of about 1/6 to about 1/10. In the illustrative example of FIGS. 2 and 3, the gradient of the surface 11*a* is 9.5°. In addition, it is desirable that each wave be generated on the offshore side of the reef with a high initial velocity and a relatively steep wave front. Preferably, the ratio of the wave height (H) to wave length ($L_0$) is in the range of about 0.0023 to about 0.0035 so that the wave breaks in a plunging mode. The plunging mode is the mode which produces a space between the breaking part of the wave as it curls downwardly, the leading edge of the wave, and the face of the wave behind the breaking portion.

Waves having the properties described above can be generated by any suitable wave generation equipment, such as the apparatus described in U.S. Pat. No. 4,999,860. Reference can be had to said U.S. patent for a detailed description of the structure and operation of the wave-making apparatus, but in general a large reservoir of water is formed above the quiescent water level in the pool. The lower end of the reservoir is closed by a controllable valve, and beneath the valve a passageway conducts water from the reservoir into the pool to generate a wave. After the valve has been re-closed, the reservoir is re-filled with water from the pool by means of a pump.

In order to cause the initial or incipient breaking of the wave to progress laterally across the wave front, the wave-breaking surface 11*a* does not extend parallel to the wave front generated by the wave machines, but rather diverges from those wave fronts toward the shore at an acute angle. Consequently, the wave front impinges on the wave-breaking surface 11*a* progressively in the lateral direction, thereby causing the breaking of the wave to "peel" laterally along the wave front. In the illustrative example of FIG. 1, the acute angle is 45°, and the wave-generating machines 13*a*–*d* and 14*a*–*d* are installed at 15-meter intervals in both the latitudinal and longitudinal directions from the central machine 12.

To produce a single continuous wave which breaks progressively along the entire wave-breaking surface 11*a* formed by the reef extending along the multiple wave-generating stations, waves produced at the individual stations 13*a*–13*d* and 14*a*–14*d* are generated sequentially, so that each wave forms a continuation of the immediately preceding wave generated by the immediately adjacent wave-generating station. Thus, the entire array of wave-generating stations 12 and 13*a*–13*d* is activated sequentially, so that waves generated by the array of stations merge to form a single continuous wave on the offshore side of the wave-breaking surface 11*a* of the reef 11. Consequently, the adjoining edges of the waves generated by the two machines 12 and 13*a*, for example, impinge on the leading edge of the wave-breaking surface 11*a* at the same time. The wave generated by the machine 13*a* thus merges with and forms a continuation of the wave previously generated by the machine 12, as the two waves propagate toward the shore.

As the waves from the array of wave-generating stations merge to form a single continuous wave that breaks progressively along the wave-breaking surface 11*a*, a single continuous tube is formed by the breaking of this continuous wave, and a surfer can ride at the leading edge of that tube as the wave peels progressively along the wave front. Consequently, a relatively long tube ride can be executed by a surfer as the wave peels diagonally across the surfing pool.

As successive increments of the wave traverse the reef which causes the wave to break, the "soup" of the broken wave dissipates as it is carried up a more gradual incline formed by the bottom of the pool between the shore side of the reef 11 and the shore itself.

Figure 4:
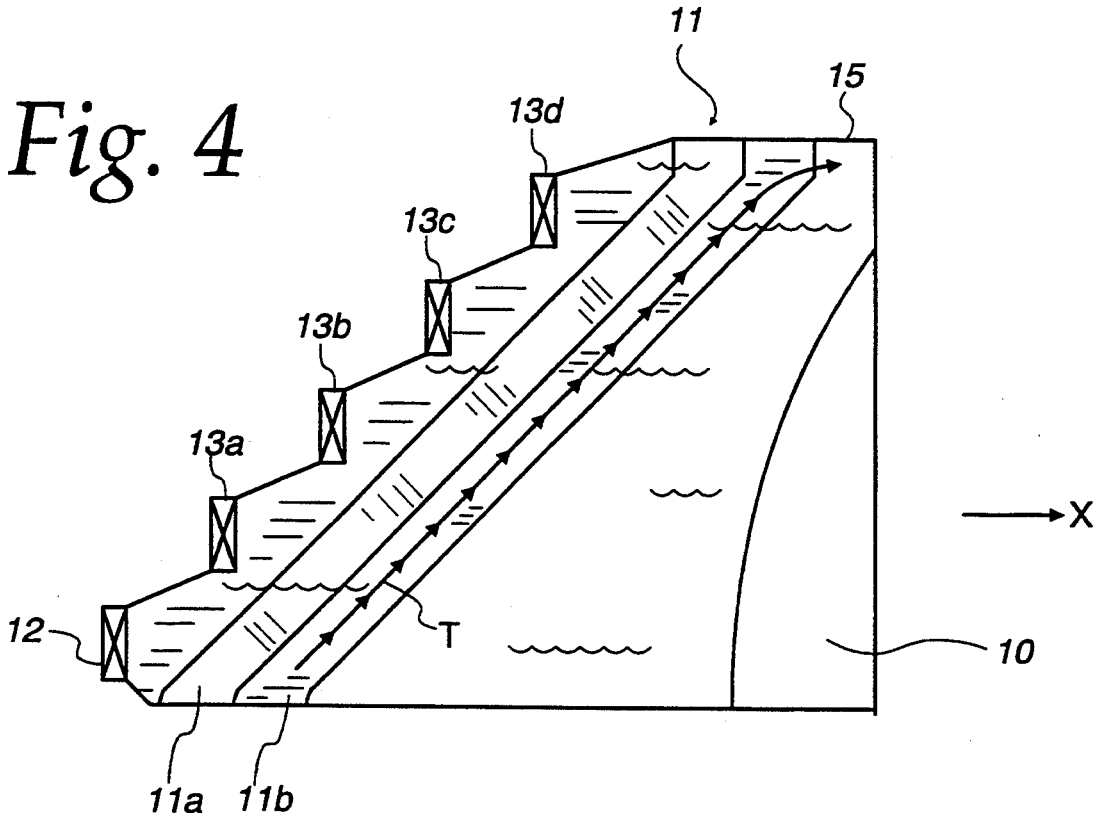
FIG. 4 is a top plan view of a modified form of surfing pool embodying the invention.

FIG. 4 illustrates a smaller surfing pool corresponding to approximately one half of the pool of FIG. 1. The reef 11 has the same cross-sectional configuration shown in FIGS. 2 and 3. The tube-riding line T extends in only one direction.

Figure 5:
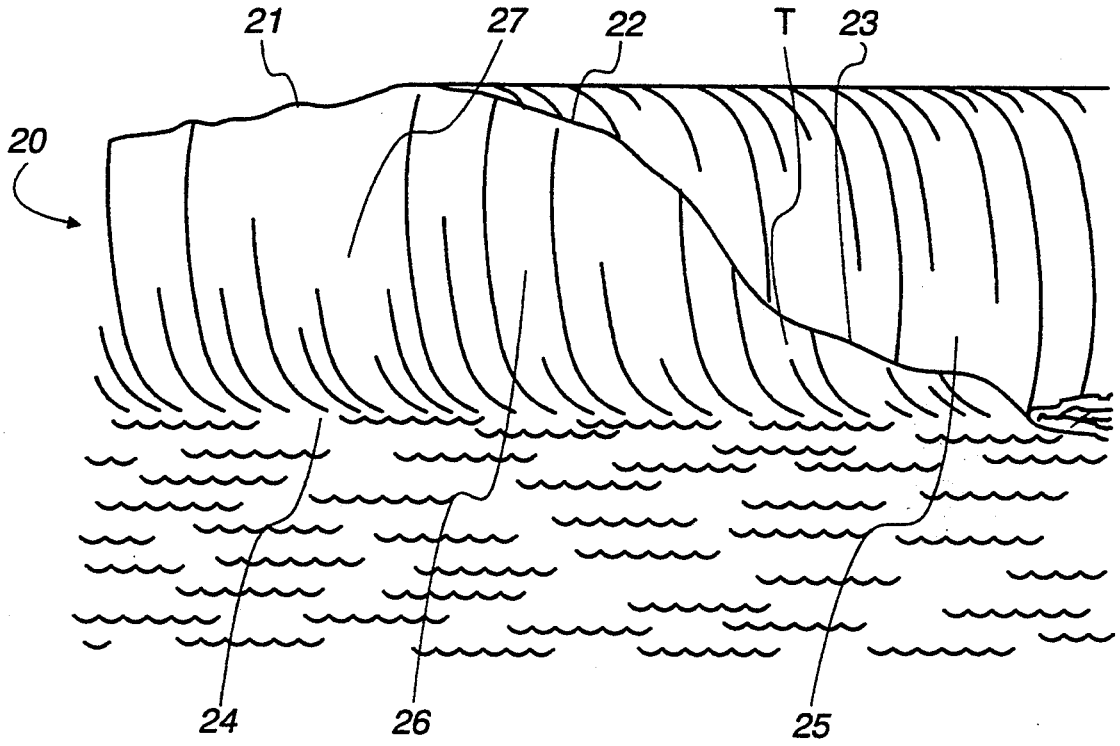
FIG. 5 is a diagrammatic illustration of a wave breaking in a plunging mode.
Figure 6:
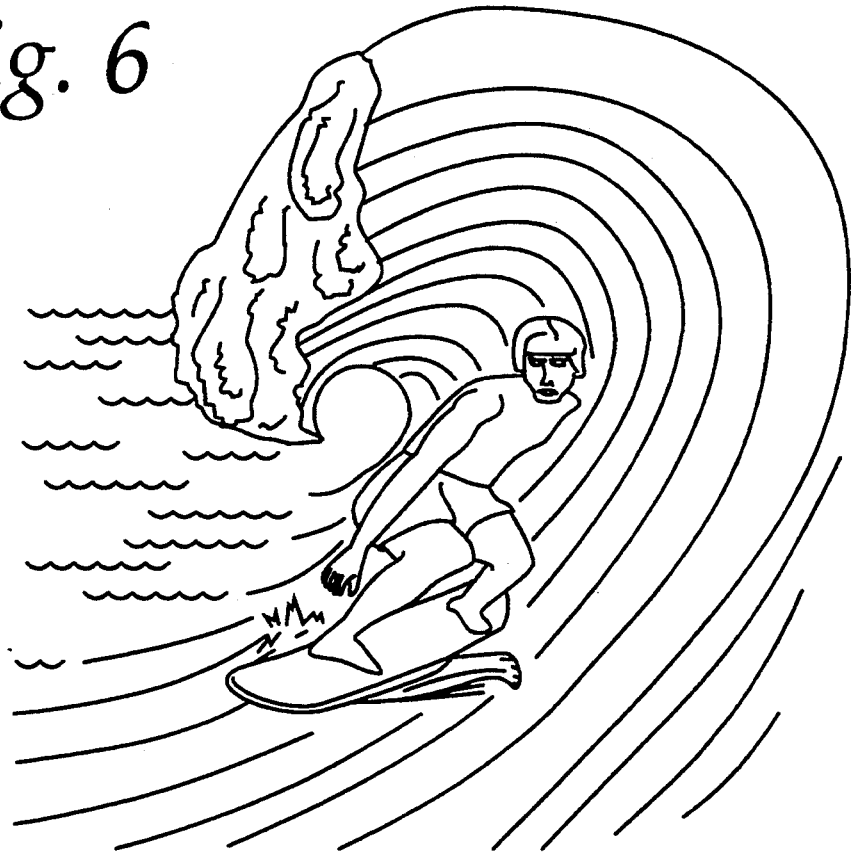
FIG. 6 is an illustration of a tube-riding surfer.
Figure 7:
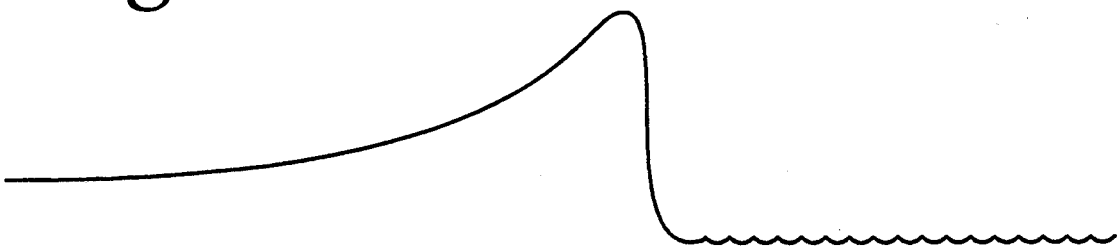
FIG. 7 is a diagrammatic illustration of a preferred form of wave.

FIGS. 5 and 6 illustrate a breaking wave. The wave 20 advances with a solid front until the top 21 of the wave begins to break at a forward lip 22. The lip 22 becomes a plunging hook 23 as the wave continues to break downwardly toward the wave bottom 24, forming white water or "soup" at the lower end 25 of the break. In a plunging wave, a space is formed between the wave face 26 and the breaking hook 23, thereby forming a tube T within which a surfer can ride by staying on the shoulder 27 of the wave or riding inside the breaking part of the wave or in the tube. FIG. 6 illustrates such a tube-riding surfer. FIG. 7 illustrates the steep wave front formed by a wave that is about to break in a plunging mode.

Figure 8:
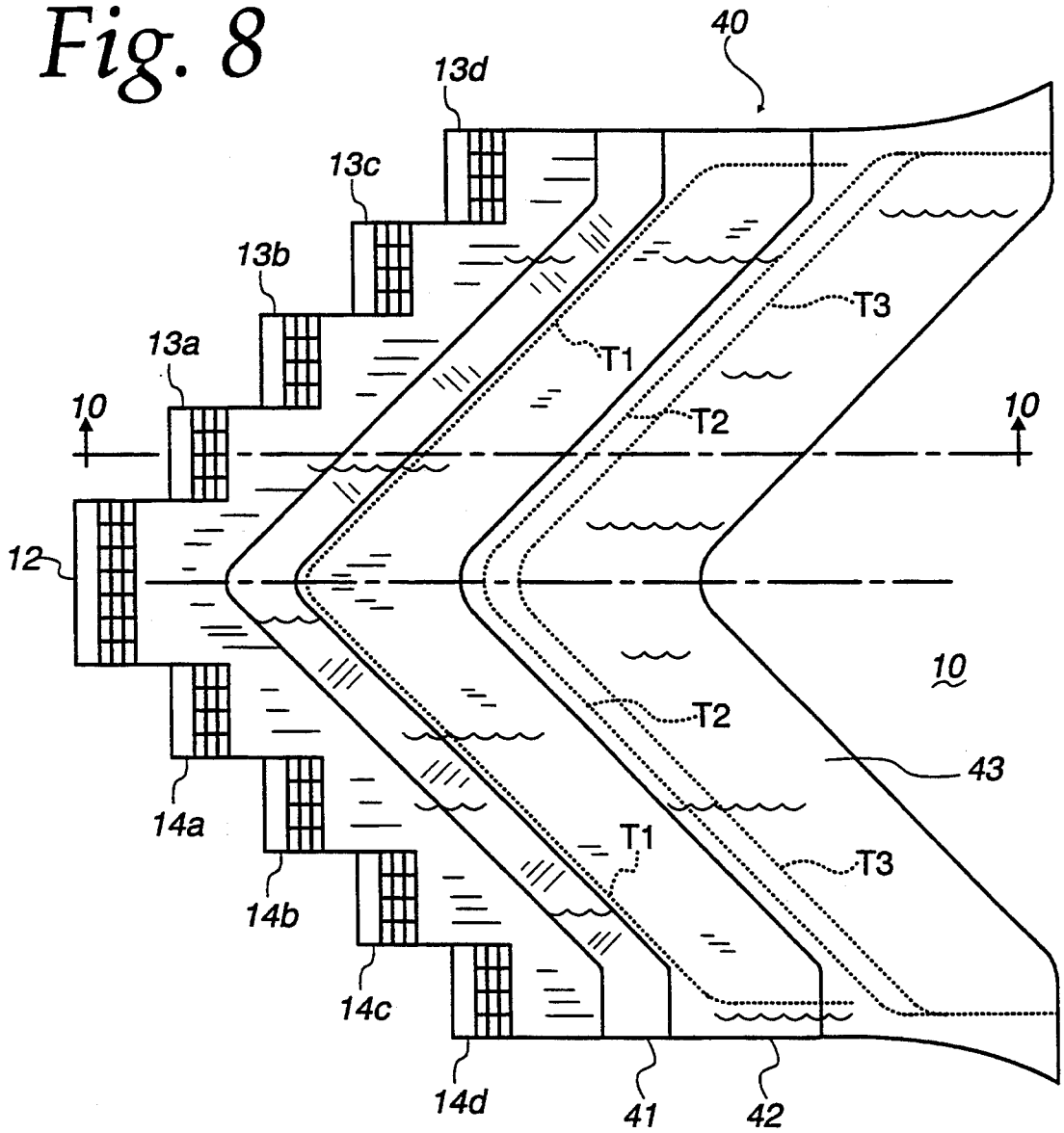
FIG. 8 is a top plan view of a modified form of surfing pool embodying the present invention.
Figure 9:
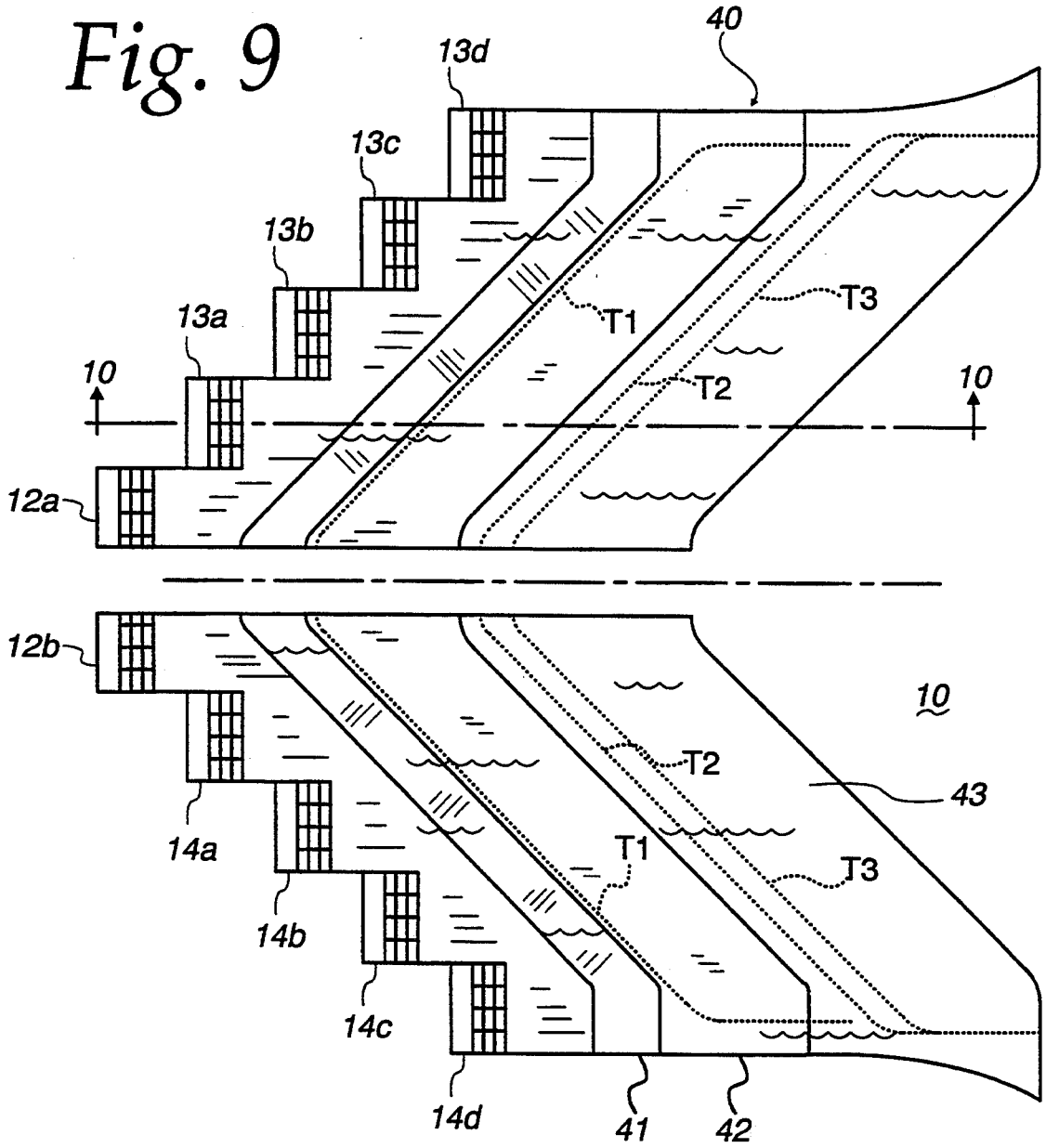
FIG. 9 is a pair of top plan views of modified forms of surfing pools embodying the present invention.

FIGS. 8 and 9 illustrate surfing pools in which there are no lateral spaces between adjacent wave-generating machines. These drawings also illustrate three different surfing lines T1, T2 and T3 for different experience levels. Specifically, line T1 is for advanced surfers, line T2 is for intermediate surfers, and line T3 is for beginners.

Figure 10:
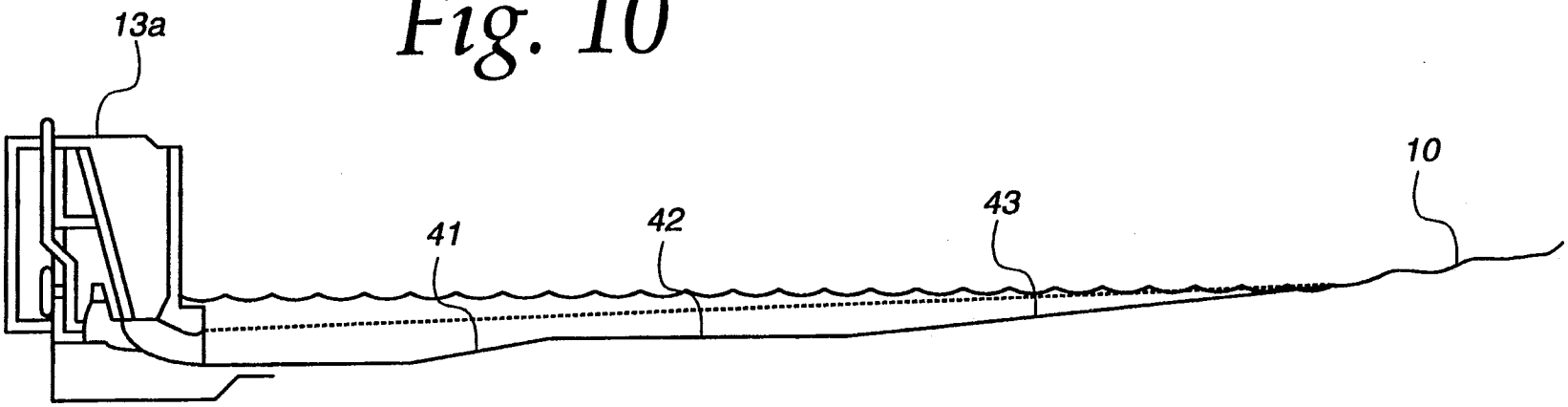
FIG. 10 is an enlarged section taken generally along line 10—10 in FIG. 8 or FIG. 9.

The reef 40 in the pools of FIGS. 8 and 9 has a modified cross-sectional configuration shown in FIG. 10. The off-shore side of the reef 40 forms a wave-breaking surface 41 having the same slope described above for the reef 11. The reef 40 then flattens out at 42 for a short distance, after which the bottom inclines at 43 with a very mild slope, typically less than 1/25, until the shoreline is reached. This configuration for the pool bottom allows for a variation in the wave height to accommodate a range of surfing abilities, from beginners to the advanced. For advanced surfers a large wave is generated and breaks over the wave-breaking surface of the reef to form a plunging wave or tube. For less experienced surfers a smaller wave is generated so that the unbroken wave will pass over the steep part of the reef and break only when it reaches the mildly sloped surface 43, which causes the wave to break in a spilling mode which is more suitable for beginners and intermediate surfers. These waves still peel, but do not break with a harsh plunge. Thus by regulating the wave height a range of wave types can be produced to suit all standards of surfers.

For windsurfing applications, the plunging-mode waves produced in the surfing pool described above are particularly advantageous because of the steepness of the waves. This steep wave face that exists just prior to breaking, due to the plunging wave nature, allows the windsurfer to gain maximum height due to a large windsurfing travel velocity and the steepness of the wave face, used as a ramp for takeoff. Non-plunging waves, e.g., spilling waves, do not possess such a steep wave face prior to breaking and so the windsurfer launch angle is not as great and, consequently, the windsurfer cannot obtain as great a height as that obtainable from a plunging wave.

Figure 11:
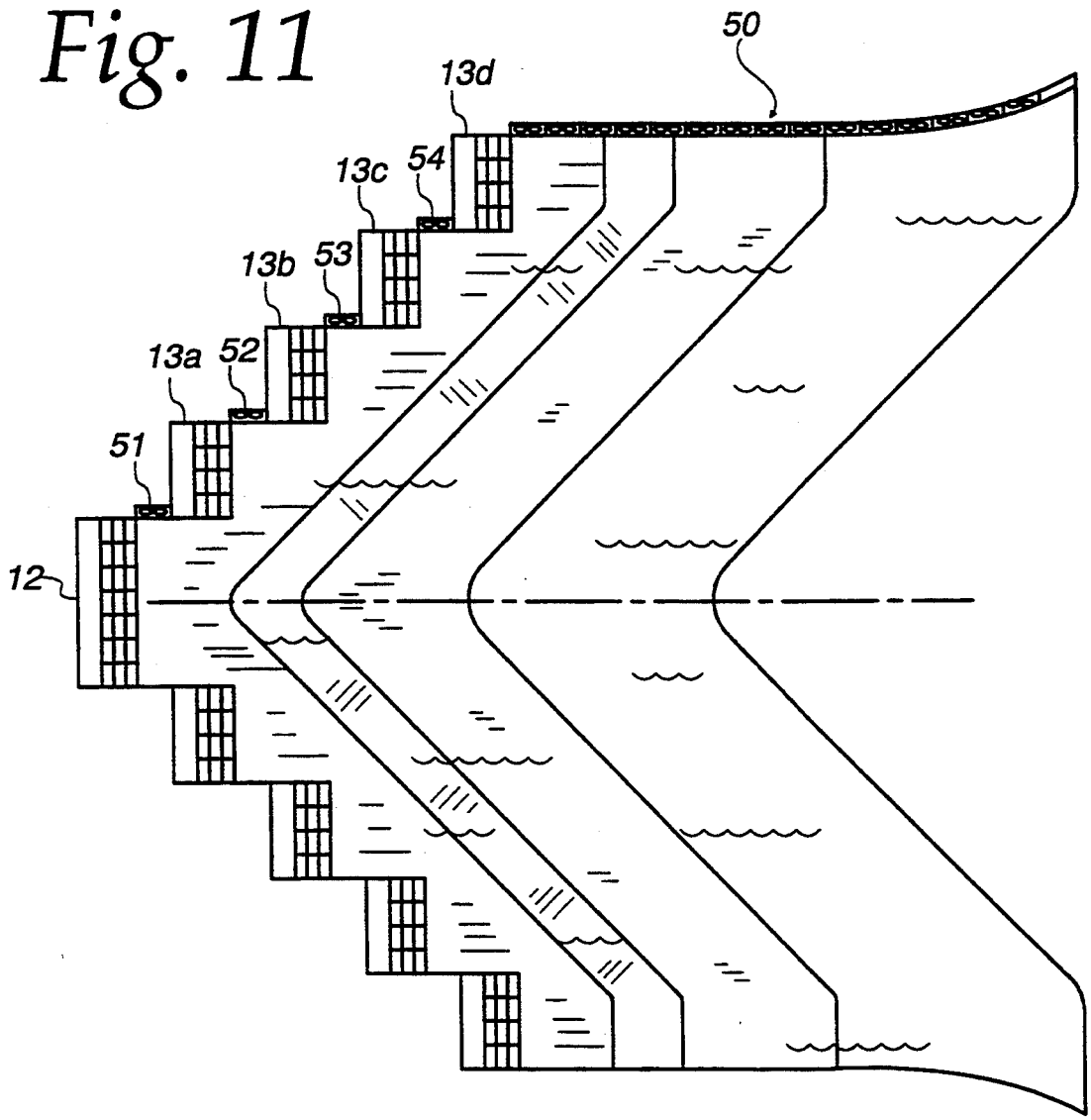
FIG. 11 is a top plan view of a wind surfing pool embodying the present invention.

To provide the air movement required for windsurfing, a bank of fans 50 is mounted along one of the end walls of the surfing pool, as illustrated in FIG. 11. Additional fans 51–54 are mounted adjacent the respective wave generators 13*a*–13*d* to provide air movement across the surfing pool. The air movement produced by this entire array of fans produces a cross wind over the entire pool surface so that windsurfing maneuvers may be executed anywhere in the pool.

Figure 12:
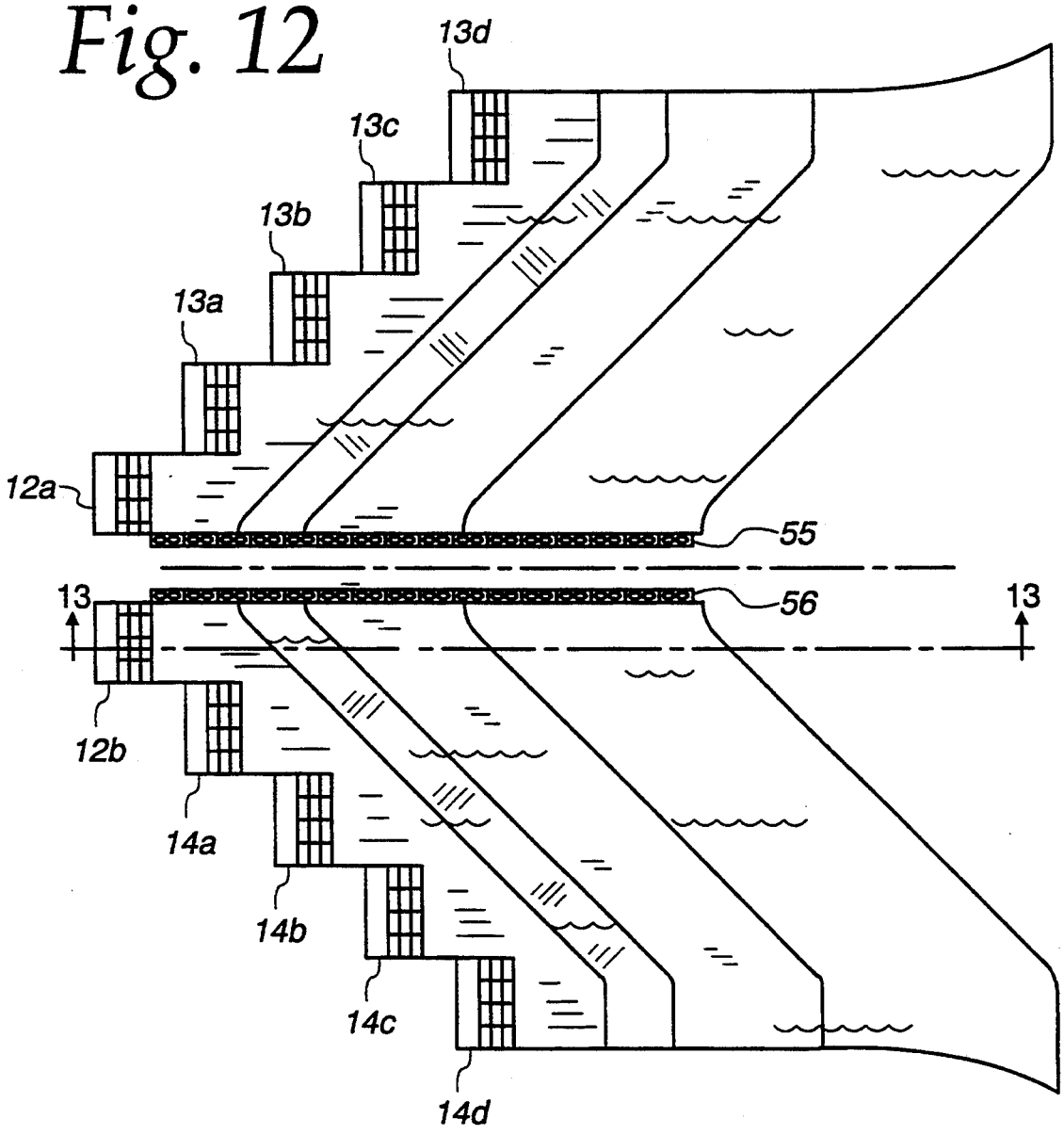
FIG. 12 is a pair of top plan views of modified forms of windsurfing pools embodying the present invention.
Figure 13:
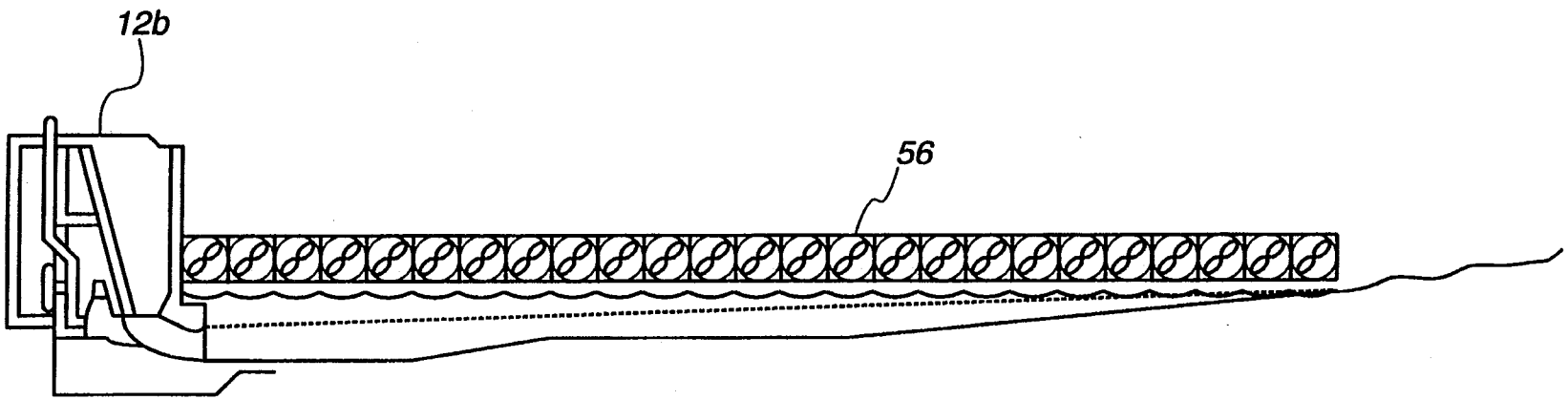
FIG. 13 is an enlarged section taken along line 13—13 in FIG. 11 or FIG. 12.

In FIG. 12, two different versions of the surfing pool are shown, each with its own bank of fans 55 or 56 mounted along the longer side of the pool. FIG. 13 is an enlarged section showing the bank of fans 56.

It will be understood that the surfing pools described herein may be entirely man-made or may be built from a natural body of water such as a lake, estuary, river or beach. Thus, the wave-breaking reef may be made of concrete or fiberglass-reinforced resin, or of a natural material such as stone. It should also be noted that the reef need not be perfectly linear, as illustrated, but if desired may be formed with a curved (either convex or concave) or even irregular configuration.

I claim:

1. A method of producing plunging waves for surfing in a body of water, comprising forming a reef at the bottom of said body of water, the offshore side of said reef forming a wave-breaking surface which inclines upwardly toward the shore at a substantially constant predetermined angle, and generating waves on the offshore side of said reef and propagating toward the shore, said waves having a steepness sufficient to cause the waves to break in a plunging mode as the waves traverse said inclined wave-breaking surface, said inclined wave-breaking surface extending across the wave front and inclining upwardly toward the shore at said substantially constant predetermined angle to produce a continuous plunging wave along said inclined wave-breaking surface as the waves traverse said inclined wave-breaking surface.

2. The method of claim 1 wherein the slope of the upwardly inclined wave-breaking surface is in the range of about $\frac{1}{4}$ to about 1/25, and the wave height (H) to length ($L_0$) ratio $H/L_0$ is in the range of about 0.0023 to about 0.0035 so that the wave breaks in a plunging mode.

3. The method of claim 2 wherein said slope is in the range of about 1/6 to about 1/10.

4. The method of claim 1 wherein said wave-breaking surface extends laterally at a substantially constant, predetermined acute angle from the wave front to provide a uniform rate of wave peeling as the waves traverse said inclined wave-breaking surface, and each wave is progressively generated laterally along said surface so that the wave progressively breaks in said plunging mode laterally along the wave front.

5. The method of claim 4 wherein said acute angle is in the range from about 30° to about 70°.

6. The method of claim 4 wherein each wave is generated at multiple locations distributed laterally along the offshore side of said reef, and waves are generated in sequence at said multiple locations.

7. The method of claim 6 wherein said multiple wave-generating locations are all spaced about the same distance from said wave-breaking surface.

8. The method of claim 6 wherein said wave-breaking surface extends continuously across the shore sides of said wave-generating locations, and waves are generated at said multiple locations in sequence so that a tube formed by the breaking of a wave generated at a first location is continued by the breaking of a wave generated at a second location adjacent to the first location.

9. A surfing pool for producing plunging waves in a body of water adjacent a shore, said pool comprising a reef at the bottom of said body of water, the offshore side of said reef forming a wave-breaking surface which inclines upwardly toward the shore at a substantially constant predetermined angle, and means for generating waves on the offshore side of said reef and propagating toward the shore, said waves having a steepness sufficient to cause the waves to break in a plunging mode as the waves traverse said inclined wave-breaking surface, said inclined wave-breaking surface extending across the wave front and inclining upwardly toward the shore at said substantially constant predetermined angle to produce a continuous plunging wave along said inclined wave-breaking surface as the waves traverse said inclined wave-breaking surface.

10. The surfing pool of claim 9 wherein the slope of the upwardly inclined wave-breaking surface is in the range of about $\frac{1}{4}$ to about 1/25, and the wave height (H) to length ($L_0$) ratio $H/L_0$ is in the range of about 0.0023 to about 0.0035 so that the wave breaks in a plunging mode.

11. The surfing pool of claim 10 wherein said slope is in the range of about 1/6 to about 1/10.

12. The surfing pool of claim 10 wherein said wave-breaking surface extends laterally at a substantially constant, predetermined acute angle from the wave front to provide a uniform rate of wave peeling as said waves traverse said inclined wave-breaking surface, and said wave-generating means includes multiple wave-generating machines spaced along the offshore side of said surface so that each wave is progressively generated laterally along said surface to cause the wave to progressively break in said plunging mode laterally along the wave front.

13. The surfing pool of claim 12 wherein said acute angle is in the range from about 30° to about 70°.

14. The surfing pool of claim 13 which includes means for generating waves in sequence from said multiple machines.

15. The surfing pool of claim 12 wherein said multiple wave-generating machines are all spaced about the same distance from said wave-breaking surface.

16. The surfing pool of claim 15 wherein said wave-breaking surface extends continuously across the shore sides of said wave-generating locations, and which includes means for generating waves in sequence from said multiple machines so that a tube formed by the breaking of a wave generated from a first machine is continued by the breaking of a wave generated from a second machine adjacent to the first machine.

* * * * *